United States Patent [19]

Bruinink et al.

[11] Patent Number: 5,035,952

[45] Date of Patent: Jul. 30, 1991

[54] BALLISTIC STRUCTURE

[75] Inventors: Peter Bruinink, Maastricht; Wilhelmus A. R. M. Pessers, Liempde, both of Netherlands

[73] Assignee: Stamicarbon B.V., Geleen, Netherlands

[21] Appl. No.: 347,686

[22] Filed: May 5, 1989

[30] Foreign Application Priority Data

May 6, 1988 [NL] Netherlands ..... 8801195

[51] Int. Cl.[5] ..... B32B 15/08

[52] U.S. Cl. ..... 428/461; 428/516; 524/585

[58] Field of Search ..... 524/585; 428/516, 500, 428/457

[56] References Cited

U.S. PATENT DOCUMENTS 2,399,184 4/1986 Heckert ..... 428/461
4,344,908 8/1982 Smith et al. ..... 524/585 X
4,411,854 10/1983 Maurer et al. ..... 524/585 X
4,422,993 12/1983 Smith et al. ..... 524/585 X
4,430,383 2/1984 Smith et al. ..... 524/585 X
4,436,689 3/1984 Smith et al. ..... 524/585 X

FOREIGN PATENT DOCUMENTS 0089537 9/1983 European Pat. Off. ..... 428/461

*Primary Examiner*—Thomas J. Herbert, Jr.
*Attorney, Agent, or Firm*—Cushman, Darby & Cushman

[57] ABSTRACT

Ballistic structure comprising a solid combination of a metal first layer and a second layer consisting of a composite fiber material containing fibers with a tensile strength of at least 2 GPa and a modulus of at least 20 GPa, based on polyethylene with a weight average molecular weight of at least $4 * 10^5$ and a thermoplastic binding agent shows good ballistic properties if a binding layer is applied between the first layer and the second layer, which binding layer contains a modified polyolefin.

5 Claims, No Drawings

BALLISTIC STRUCTURE

BACKGROUND OF THE INVENTION

1. Field of the Invention

The invention relates to a flat or bent ballistic structure comprising a solid combination of a first layer consisting of a metal and a second layer made from a composite of fiber material and a binding agent.

In particular, the structures according to the invention serve to protect the human body, especially in the form of a helmet to protect the head against projectiles such as bullets, shell fragments and the like. The second layer is considered to be the layer, which in normal use, faces the body to be protected.

DESCRIPTION OF THE PRIOR ART

Such a structure is known from EP-A-0188747. By using two layers, one of metal and one of a fiber and plastic composite, a structure is obtained that is relatively light, has high ballistic resistance and a low cost. According to EP-A-0188747, the fiber used particularly is ballistic aramide, for example Kevlar (tradename for an aromatic polyamide fiber of Du Pont de Nemours, E.I. Co. USA). A disadvantage of using aramide fibers is that the second layer that is therewith is sensitive to ambient conditions. In particular, it is very sensitive to water. If the second layer containing aramide firers comes into contact with water vapour, cracks, flakes or soft patches may be formed, which have a strong adverse effect on the ballistic properties of the second layer. Moreover, it has been found that when a protective part consisting of metal and a composite containing aramide firers is impacted, the second layer easily bulges even if there is no complete penetration of the projectile.

SUMMARY OF THE INVENTION

The aim of the invention is to manufacture a structure that is not sensitive to ambient conditions, has great ballistic resistance, can be produced in a simple and cheap manner and is relatively light.

DETAILED DESCRIPTION OF THE PRESENTLY PREFERRED EXEMPLARY EMBODIMENT

This aim is achieved according to the invention in that as fiber material a material is chosen which contains fibers with a tensile strength of at least 2 GPa and a modulus of at least 20 GPa, based on polyethylene with a weight average molecular weight of at least $4 * 10^5$.

In particular, use may be made in the present invention of fibers obtained by converting, by thermoreversible gelling, a solution of a polyethylene with a weight average molecular weight of at least $6 * 10^5$ into a homogeneous polyethylene gel with practically the same composition as the starting solution and stretching this gel at a draw ratio of at least 10, in particular at least 30.

The preparation of such fibers has been described in, for example, U.S. Pat. Nos.4,344,908; 4,422,993; 4,430,383; 4,411,854 and 4,436,689.

The form in which the fibers are applied in the composite is not essential. The fibers may be present in the form of monofilaments or in the form of yarns of several monofilaments or composed of staple fibers. The yarns may be used per se, as 'non-woven', knitted or woven yarns, all this according to methods known for the preparation of composites. Preferably a fabric of multifilament yarn is used. Different known weaves are suitable, for example plain weaves, basket weaves, twill weaves or satin weaves.

The binding agent in the second layer may be either thermosetting plastic or thermoplastic. Examples of thermosetting plastics that may be used are modified phenol-formaldehyde resins, epoxy resins or resins of vinyl esters or polyester. Preferably a thermoplastic is incorporated in the composite; particularly suitable are polyolefins, in particular polyethylene. Very suitable is a linear low-density polyethylene (LLDPE) with a melt flow index, determined according to ISO 1130 (A/4), of at least 5 dg/min and a Vicat softening temperature, determined according to ISO 306A, of less than 135C. The amount of binding agent in the composite is 5–50 wt. %, preferably 15–25 wt. %, based on the total weight of the composite.

The first layer consists of a metal or a metal alloy which is commonly known per se as a ballistic material, such as steel, aluminum, titanium. Preferably, steel is used for the first layer. To improve the adhesion of the metal and the composite, the surface of the metal is preferably roughened, for example by scouring or sand blasting.

According to the invention, there is a binding layer between the second layer and the outer metal shell. Particularly if the second layer consists of a composite of polyethylene fiber combined with a polyolefin plastic, this binding layer can improve the adhesion between the metal of the first layer and the composite of the second layer. In that case the binding layer preferably contains a modified polyolefin. More preferably the binding layer contains a copolymer of ethylene and an $\alpha$-olefin or an ethylenically unsaturated ester, for instance vinylacetate, and a graft copolymer of polyethylene and at least one unsaturated fused ring carboxylic acid anhydride.

The structure can be composed of the aforementioned components in a known manner. For example, a package of layers of molded fabric impregnated with plastic components that set under the influence of heat can be compression molded onto the metal layer, which is meanwhile heated. This method is worked out for a helmet in EP-A-0224015. A different method for composing the structure is for example to mold a laminate of layers of fabric alternated with thermoplastic films. This laminate can then be compression molded onto a heated metal layer, with heating. In this process, the binding layer between the component and the metal can be easily applied placing a film of suitable material between the composite and the metal before compression molding. After compression molding in the aforementioned manner the assembly is allowed to cool, after which a structure is obtained, in which the second layer and the metal first layer constitute a solid assembly.

The invention will be elucidated with the aid of the following examples.

Test methods used:

As a measure of the ballistic resistance use was made of the V50 value for projectiles of calibres 0.22 and 9 mm parabellum determined according to methods MIL-STD-662B/1971 and MIL-P-46593 (ORD)/1962 of the American army.

EXAMPLE I

Ballistic helmets A to E were produced by compression molding the following materials at a temperature of 125*C:

First layer: steel sheet with an average thickness of 1 mm, type Duressa(TM), supplied by Ulbricht GmbH.

Second layer: composite of 12 layers of cut satin-weave fabric with a density of 0.150 kg/m$^2$ of Dyneema (TM) polyethylene fibers alternated with 12 layers of polyethylene film with an average thickness of 50 um, type Stamylex (TM) 4408, delivered by DSM.

Binder layer (average thickness 50 $\mu$m in every helmet):

A helmet: Plexar (TM) 169 delivered by DSM

B helmet: Plexar (TM) 326 delivered by DSM

C helmet: no binding layer

D helmet: epoxy glue, DER (TM) XZ 87740, delivered by DOW Chemical

E helmet: PUR glue, Resicoat (TM) RD 3184, delivered by Resina Chemie.

The helmets obtained have a weight per surface area unit of 10.9 kg/m$^2$ (of which 7.5 kg/m$^2$ of the first layer and 3.4 kg/m$^2$ of the second layer and binding layer).

The composite in the helmet is highly resistant to ambient conditions and is in particular very insensitive to water.

The V50 values according to the aforementioned test methods are determined with calibre 0.22 and 9 mm parabellum projectiles. The 'blunt trauma' effect is determined and characterized by means of the bulging of the second layer. The bulging is measured when the calibre 0.22 has impacted the helmet at the V50 value. The results are given in table 1.

TABLE 1

| helmet | V50, calibre .22 [m.s$^{-1}$] | V50, calibre 9 mm parabellum [m.s$^{-1}$] | Bulging [mm] |
|---|---|---|---|
| A | 600 | 390 | 15 |
| B | 605 | 385 | 15 |
| C | 580 | 365 | 30 |
| D | 585 | 360 | 25 |
| E | 575 | 360 | 25 |

Both helmets A and B produced by using Plexar (TM) 169 and Plexar (TM) 326, containing modified polyolefins give the best results.

EXAMPLE 2:

Ballistic helmets F, G and H were produced by compression molding the following materials at a temperature of 135*C:

First layer: steel sheet with an average thickness of 1 mm as in example 1.

Second layer: composite composed of 12 layers of cut satin-weave fabric as in example 1 impregnated with epoxy resin.

Binding layer (average thickness 50 $\mu$m in every helmet): F helmet: Plexar R 169 G helmet: epoxy glue, as in example 1 H helmet: PUR glue, as in example 1

The helmets obtained have very high resistance to the influence of water (vapor) and have a weight per surface area unit of 11.6 kg/m$^2$ (of which 7.5 kg/m$^2$ of the first layer and 4.2 kg/m$^2$ of the second layer).

V50 and bulging values are determined as in example 1 and are given in table 2.

TABLE 2

| helmet | V50, calibre .22 [m.s$^{-1}$] | V50, calibre 9 mm parabellum [m.s$^{-1}$] | Bulging [mm] |
|---|---|---|---|
| F | 590 | 395 | 35 |
| G | 585 | 385 | 40 |
| H | 585 | 390 | 35 |

There is a great 'blunt trauma' effect if an epoxy resin is used as binding agent.

EXAMPLE 3

A ballistic structure was produced by compression molding the following materials at a temperature of 125*C.

First layer: flat steel sheet with an average thickness of 12.5 mm, type Mars (TM) 240, delivered by Creusot-Loire Industrie.

Second layer: composite of 39 layers of cut satin weave fabric as in example 1 alternated with 39 layers of polyethylene film as in example 1.

Binding layer: Plexar (TM) 326 film with an average thickness of 50 $\mu$m.

The ballistic structure was impacted with calibre 7.62 AP according to NIJ 0108.01 standard with a speed of 800 m/s. There was hardly any bulging effect.

We claim:

1. A ballistic structure comprising:

a solid combination of a first layer consisting of a metal and a second layer consisting of a composite of fiber material containing fibers having a tensile strength of at least 2 GPa and a modulus of at least 20 GPa, based on polyethylene with a weight average molecular weight of at least 4 * 10$^5$;

and a binding agent containing a thermoplastic polymer wherein a binding layer is applied between the first layer and the second layer, said binding layer containing a graft copolymer of polyethylene and at least one unsaturated fused ring carboxylic acid anhydride and a copolymer of ethylene and an ethylenically unsaturated ester or an $\alpha$-olefin.

2. A ballistic structure according to claim 1, wherein the first layer consists of steel.

3. A helmet molded from a ballistic structure according to claim 1.

4. A ballistic structure according to claim 1 wherein the binding agent consists of a polyolefin.

5. A ballistic structure according to claim 4, wherein the polyolefin is a lineair low-density polyethylene with a melt flow index determined according to ISO 1139 (A/4l) of at least 5 dg/min and a Vicat softening temperature determined according to ISO 306 of less than 135° C.

* * * * *